US006098862A

United States Patent [19]

Chakrabarti et al.

[11] Patent Number: 6,098,862

[45] Date of Patent: Aug. 8, 2000

[54] INCREMENTALLY CONTINUOUS LASER CLEAVING PROCESS

[75] Inventors: Utpal Kumar Chakrabarti, Allentown, Pa.; David Reese Peale, Chatham, N.J.

[73] Assignee: Lucent Technologies Inc., Murray Hill, N.J.

[21] Appl. No.: 09/080,663

[22] Filed: May 18, 1998

[51] Int. Cl.[7] ..... B65H 20/00

[52] U.S. Cl. ..... 225/96.5; 225/94; 225/93.5; 65/174; 65/176

[58] Field of Search ..... 225/96.5, 94, 93.5, 225/103, 105, 2; 65/174, 61, 112, 176; 427/226

[56] References Cited

U.S. PATENT DOCUMENTS

| | | | |
|---|---|---|---|
| 3,244,337 | 4/1966 | Curtze et al. | 225/96.5 |
| 3,918,150 | 11/1975 | Gantley | 29/583 |
| 4,213,550 | 7/1980 | Bonaddio | 225/96.5 |
| 4,216,004 | 8/1980 | Brehm et al. | 225/96.5 |
| 4,698,088 | 10/1987 | Bando | 225/96.5 |
| 4,995,539 | 2/1991 | Richard . | |
| 5,104,023 | 4/1992 | Nishiguchi et al. | 225/103 |
| 5,125,549 | 6/1992 | Blackman et al. | 225/96.5 |
| 5,154,333 | 10/1992 | Bauer et al. . | |
| 5,171,717 | 12/1992 | Broom . | |
| 5,382,276 | 1/1995 | Hakoun et al. | 65/433 |
| 5,393,707 | 2/1995 | Canning | 437/226 |
| 5,418,190 | 5/1995 | Cholewa et al. | 437/226 |
| 5,773,318 | 6/1998 | Chand et al. | 438/33 |
| 5,780,320 | 7/1998 | Kinoshita | 438/33 |
| 5,942,137 | 8/1999 | Kamir et al. | 219/121.68 |

FOREIGN PATENT DOCUMENTS

| | | | |
|---|---|---|---|
| 0941027 | 1/1978 | U.S.S.R. | 225/96.5 |

*Primary Examiner*—Jessica J. Harrison
*Assistant Examiner*—Minh Trinh
*Attorney, Agent, or Firm*—Wendy W. Koba

[57] ABSTRACT

An incrementally continuous cleaving system allows for sequential flow of "material-to-be-cleaved" through a cleaving apparatus. In particular, a continuous feed tape membrane is used to support sequentially loaded optical bars (or, perhaps, wafers) that are then transported into a cleaving apparatus. The tape is advanced in small increments so that individual cleaving operations are performed at each scribe mark location on the top surface of the optical material. A vacuum pen (assisted by a detach pin) is then used to remove the cleaved section from the cleaving system. A conventional pick-and-place device may be used in the first instance to continuously load the bars (or wafers) onto the tape membrane.

8 Claims, 2 Drawing Sheets

INCREMENTALLY CONTINUOUS LASER CLEAVING PROCESS

BACKGROUND OF THE INVENTION

The present invention relates to a laser cleaving process and, more particularly, to a continuous flow process that allows for the material to be cleaved to be presented to the cleaving apparatus in a continuous time arrangement.

Present systems for cleaving semiconductor optical bars into individual optical devices involves loading a set of bars onto a membrane (formed as a hoop or frame-supported diaphragm) such that the devices on each bar are aligned from one bar to another, then manually bringing the cleaving apparatus into contact with the aligned bars and performing sequential scribing and cleaving operations to form multiple, separated individual devices. The process is extremely time consuming and requires one or more operators to perform the procedure effectively and efficiently.

SUMMARY OF THE INVENTION

The present invention relates to a laser cleaving process and, more particularly, to a continuous flow process that allows for the material to be cleaved to be presented to the cleaving apparatus in a continuous time arrangement.

In accordance with the present invention, the material to be cleaved is placed on a support membrane which is in the form of a continuous strip. A conventional pick-and-place tool may be used to perform this step and place the material so that the direction of the cleave is essentially perpendicular to the direction of movement of the continuous strip. The conveyor strip is advanced so that an alignment means (such as a vision camera) can align the cleave scribe mark with the cleaving apparatus. Once alignment is achieved, the cleaving apparatus is activated and the material is separated. A removal arrangement, such as a vacuum system is then used to pick up and transport the cleaved section for subsequent process. Once a first cleave has been performed, the strip moves forward incrementally and aligns the next scribe mark for cleaving. As a first set nears completion, the pick-and-place unit has set a second unit on the continuous strip. Therefore, a plurality of bars (or, perhaps, wafers) may pass through the cleaving apparatus without a need to "turn off" and reload the system.

It is to be understood that the incrementally continuous cleaving process of the present invention may be used in conjunction with any acceptable cleaving apparatus, such as a knife edge or mandrel arrangement. A preferred embodiment of the present invention utilizes an anvil pad as disclosed in our copending application Ser. No. 09/080,648, filed May 18, 1998 and wire cleaving tool as disclosed in our copending application Ser. No. 09/071,629, filed May 1, 1998.

Other and further advantages of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
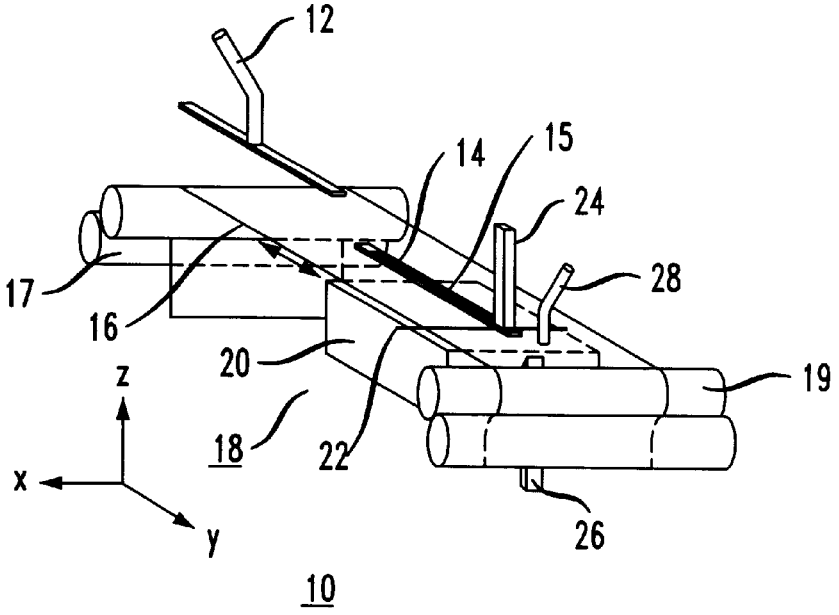
FIG. 1 illustrates an exemplary incrementally continuous cleaving process of the present invention in an arrangement for cleaving semiconductor optical bars into individual devices.

An exemplary incrementally continuous cleaving system 10 is illustrated in FIG. 1. As shown, cleaving system 10 utilizes a pick-and-place arm 12 to load the material, in this example, a bar 14, onto a continuous membrane tape 16 that functions as a conveyor belt to transport bar 14 into the cleaving area. Bar 14 is loaded so that the scribe marks 15 formed on the top surface of bar 14 are essentially perpendicular to the direction of motion of tape 16. Referring to FIG. 1, tape 16 is driven by a mechanism 17 to move in the direction indicated by the arrow and bring bar 14 into position with cleaving apparatus 18. An alignment system, such as a vision system (not shown) may be used to provide alignment between a scribe mark on the surface of bar 14 and cleaving apparatus 18. In the exemplary embodiment of FIG. 1, cleaving apparatus 18 comprises a support structure 20 and cleaving wire 22 disposed under tape 16 and an anvil 24 disposed above bar 14. To achieve alignment with this particular apparatus, support structure 20 and associated cleaving wire 22 may be translated and rotated in the x-y plane until wire 22 is aligned with bar surface scribe mark 15. Once a first scribe mark is aligned with cleaving wire 22, appropriate forces are used to press against both sides of bar 14 and cause the bar to cleave along scribe mark 15 and break off an individual optical device. After a first device has been cleaved, a removing means is used to move the cleaved device into another process area.

Referring to FIG. 1, an exemplary removing means may comprise a pin 26 and vacuum pen 28, where pin 26 is disposed underneath tape 16 and is used to urge the cleaved device upwards. Pen 28 then lifts the device from the tape and moves the device to the next process area. An advantage of the continuous tape arrangement of the present invention is that additional tension may be placed on tape 16 by roller 19, disposed beyond the removing means. The additional tension may be used to elongate tape 16 at the output area, subsequent to the cleaving operation. The elongation functions to further separate the cleaved device from the remainder of the bar, thereby preventing contact between the device and bar from damaging the edges of the device or bar, and allowing for the removing means to lift off the cleaved device without touching the remainder of the bar.

Figure 2:
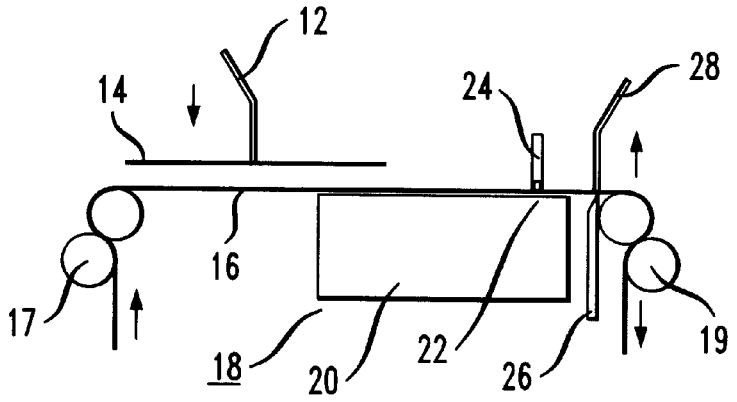
FIG. 2 is a side view of the arrangement of FIG. 1.

A side view of cleaving apparatus 10 is shown in FIG. 2. Evident in this view is the location of pin 26 and pen 28 with respect to cleaving apparatus 18. Once a first device has been cleaved from bar 14, tape 16 will advance incrementally until the next scribe mark 15 has been aligned with cleaving apparatus 18. Upon alignment, cleaving apparatus 18 will again be activated and another device will be cleaved from the bar. The process of incrementally advancing the bar and cleaving individual devices from the bar continues until the entire bar has been cleaved. An advantage of the process of the present invention is that as a first bar is being cleaved, pick-and-place device 12 is loading a second bar onto tape 16. As the second bar advances, yet another bar is placed on the tape, and so on, so that the cleaving system operates until the final bar in a load has been cleaved.

Figure 3:
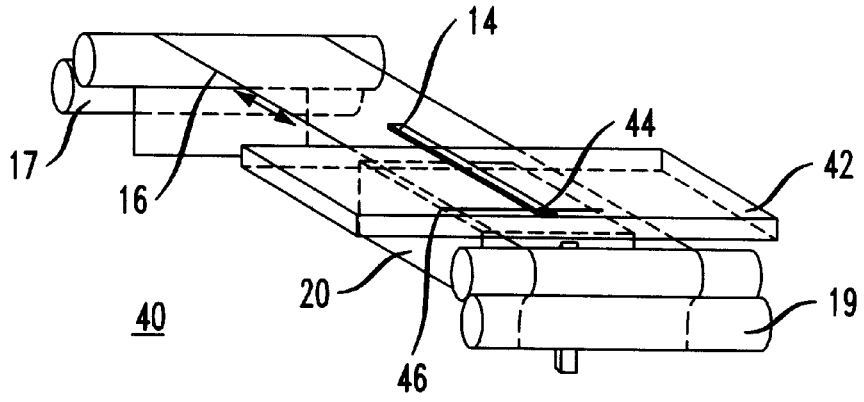
FIG. 3 is an alternative embodiment of the incrementally continuous cleaving arrangement of the preset invention.

As mentioned above, the incrementally continuous cleaving system of the present invention may be used with any appropriate cleaving apparatus, where there are many different types of cleaving tools well-known in the art. The cleaving wire 22 and anvil 24 illustrated in FIGS. 1 and 2 are considered preferred alternatives disclosed in copending applications Ser. Nos. 09/080,648 and 09/071,629, assigned to the assignee of the present application. FIG. 3 illustrates an alternative cleaving system 40 utilizing a transparent anvil substrate 42 including a deposited anvil film 44, in conjunction with a cleaving wire 46 to perform the incrementally continuous cleaving process. Other cleaving arrangements including, but not limited to knife edge cleaving and mandrel-based cleaving systems, may be used and are considered to fall within the spirit and scope of the present invention.

Figure 4:
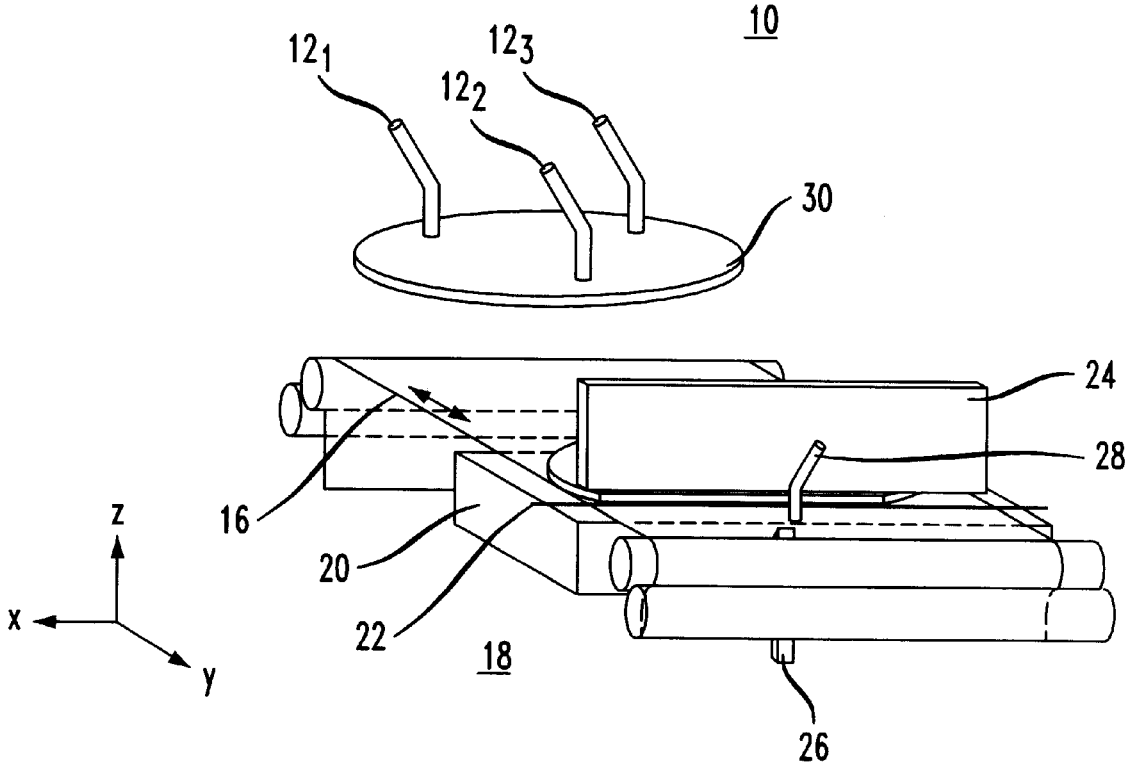
FIG. 4 illustrates an exemplary incrementally continuous cleaving process of the present invention in an arrangement for cleaving wafers into bars of semiconductor optical devices.

FIG. 4 illustrates cleaving system 10 when used to cleave wafers into bars of optical devices. As shown, pick-and-place system 12 comprises three separate arms $\mathbf{12}_1$, $\mathbf{12}_2$, and $\mathbf{12}_3$ that are used to transport a first wafer 30 to the system and load wafer 30 on tape 16. Wafer 30 then passes through cleaving apparatus 18, where scribe marks on the bar surface are aligned (one at a time) with the cleaving apparatus. After alignment of a first scribe mark, cleaving apparatus 18 is activated and a first bar is cleaved from the wafer. Vacuum pen 28 then lifts the bar and transports it to the next process area. It is to be understood that although similar elements are depicted in the two systems, the various components may differ slightly in that the relative sizes of the material to be cleaved (i.e., wafers vs. bars) may necessitate the use of slightly different tools. In general, the same incremental continuous process of the present invention may be used with either wafers or bars.

What is claimed is:

1. A system for cleaving semiconductor optical material into separate sections as defined by scribe marks formed on the surface of said optical material, said system comprising a continuous tape membrane for moving said optical material through a cleaving process;

placement means for continuously loading optical material onto said continuous tape membrane, said placement means loading said optical material such that the surface scribe marks are positioned perpendicular to the direction of movement of said tape membrane;

cleaving apparatus for sequential alignment with the optical material scribe marks and cleaving said optical material at said scribe mark locations to sequentially form sections of optical material; and removal means for unloading cleaved sections of material from said cleaving system.

2. The system as defined in claim 1 wherein the placement means is a pick-and-place device.

3. The system as defined in claim 1 wherein the cleaving apparatus includes alignment means for moving said cleaving apparatus with respect to the optical material to achieve alignment between a scribe mark and said cleaving apparatus.

4. The system as defined in claim 1 wherein the removal means comprises a detaching pin disposed under the tape for urging a cleaved section upward and away from said tape; and vacuum means disposed above the optical material for contacting said cleaved section and removing said cleaved section from the tape.

5. The system as defined in claim 1 wherein the optical material comprises bars that are cleaved into individual optical devices.

6. The system as defined in claim 1 wherein the optical material comprises wafers that are cleaved into bars.

7. The system as defined in claim 1 wherein the cleaving apparatus comprises a support substrate;

a cleaving wire disposed on said substrate, the combination of said support substrate and cleaving wire positioned underneath said tape membrane; and an anvil disposed above said optical material, the anvil capable of being lowered to contact the top surface of said optical material and effectuate a cleave along a surface scribe mark.

8. The system as defined in claim 7 wherein the support substrate includes an alignment mechanism for moving said support substrate to achieve alignment between the cleaving wire and the optical material scribe mark.

* * * * *